United States Patent [19]

Ohashi et al.

[11] 4,382,252

[45] May 3, 1983

[54] INTRUSION WARNING SYSTEM

[75] Inventors: Hiroshi Ohashi, Hirakata; Yuji Takada, Neyagawa, both of Japan

[73] Assignee: Matsushita Electric Works, Ltd., Kadoma, Japan

[21] Appl. No.: 248,903

[22] Filed: Mar. 30, 1981

[30] Foreign Application Priority Data

Mar. 31, 1980 [JP] Japan ..... 55-42324

[51] Int. Cl.[3] ..... G08B 13/26

[52] U.S. Cl. ..... 340/562; 333/17 M; 340/561; 455/69; 455/123

[58] Field of Search ..... 340/561, 562, 564; 333/17 M; 455/69, 123, 248

[56] References Cited

U.S. PATENT DOCUMENTS

| | | | |
|---|---|---|---|
| 2,490,238 | 12/1949 | Simons | 340/562 X |
| 3,281,721 | 10/1966 | Clark | 333/17 M |
| 3,384,887 | 5/1968 | Trimble | 340/561 |
| 3,445,835 | 5/1969 | Fudaley | 340/561 X |
| 3,462,692 | 8/1969 | Bartlett | 340/562 X |
| 4,174,518 | 11/1979 | Mongeon | 340/561 |
| 4,300,116 | 11/1981 | Stahovec | 340/562 X |

FOREIGN PATENT DOCUMENTS

| | | | |
|---|---|---|---|
| 2069206 | 8/1981 | United Kingdom | 340/561 |

*Primary Examiner*—John W. Caldwell, Sr.
*Assistant Examiner*—Joseph E. Nowicki
*Attorney, Agent, or Firm*—Cushman, Darby & Cushman

[57] ABSTRACT

An intrusion warning system for indicating the presence of an intruder to a given area includes an antenna provided around the area and which is insulated from the ground. An oscillator is provided for feeding an alternating current signal to the antenna, and a coupling impedance is connected between an output of the oscillator and the antenna. The coupling impedance includes an arrangement to vary the impedance to an appropriate value such that the voltage fed to the antenna is approximately 50% of the voltage fed from the oscillator to the coupling impedance. By this arrangement the detection sensitivity is always kept at an optimum. The system also includes a signal processing apparatus for producing an output signal responsive to a change in the voltage of the alternating current on the antenna exceeding a predetermined level.

7 Claims, 18 Drawing Figures

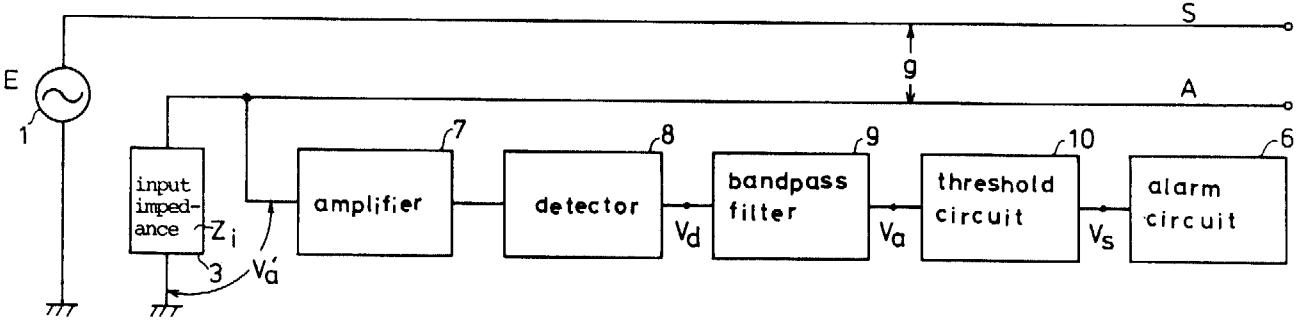
FIG.1 (a) (Prior Art)
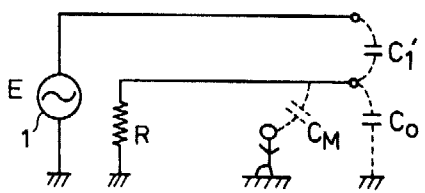
FIG.1 (b) (Prior Art)
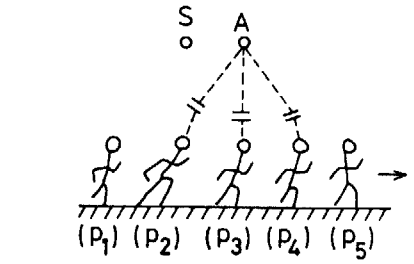
FIG.1 (c) (Prior Art)
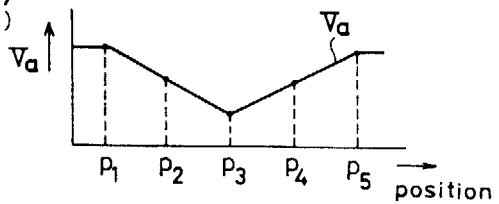
FIG.1 (d) (Prior Art)

INTRUSION WARNING SYSTEM

BACKGROUND OF THE INVENTION

1. Field of the Invention

The present invention relates to an intrusion warning system utilizing an antenna on which an A.C. voltage is impressed.

2. Description of the Prior Art

FIG. 1(*a*) is a block diagram showing an example of the conventional intrusion warning system utilizing an electric field, such as shown in the U.S. Pat. No. 4,064,499. In the system of FIG. 1(*a*), a voltage of a high frequency, for example, about 9750 Hz shown by FIG. 2(E) and generated by a signal generating circuit E is applied across a field wire S and the ground, and a voltage change induced on an antenna A disposed with a substantially uniform distance gap g from the field wire S is detected and processed to produce an intruder detecting signal. The voltage change due to the intruder is detected as follows:

Provided that a resistance between the antenna and the ground, i.e. an input impedance of the amplifier is sufficiently large, by considering the equivalent circuit of FIG. 1(*b*), the induced voltage V for the case that there is no intruder, is given by:

$$V = \frac{C_1}{C_1 + C_o} \cdot e, \tag{1}$$

wherein $C_1'$ . . . is a capacitance between the field wire S and antenna A, $C_o$ . . . is a capacitance between the antenna A and the ground, e . . . is a voltage of the high frequency signal applied to the field wire S.

Then, by considering the intruder's body as an electric conductor, and capacitance between the intruder's body and the antenna A is $C_M$, the induced voltage $V_a'$ becomes as shown by the following equation (2):

$$V'_a = \frac{C_1}{C_1 + C_o + C_M} \cdot e \tag{2}$$

The induced voltage is amplified by an amplifier 7, then detected by a detection circuit 8 as FIG. 2(*a*)($V_d$), and after passing a band-pass filter 9 led to a threshold circuit 10, where its input value $V_a'$ is compared with a predetermined threshold value $V_{th}$.

When a man passes through the electric field of the antenna A as shown by FIG. 1(*c*), the induced voltage $V_a'$ changes as shown by FIG. 2($V_a'$) by the change of the capacity $C_M$, and therefore, the input voltage $V_a$ to the threshold circuit 10 changes as shown by FIG. 2($V_a$) and by FIG. 1(*d*). Therefore, when the input voltage $V_a$ becomes lower than the predetermined threshold value $V_{thL}$, at the time $t_1$ as shown by FIG. 2($V_a$), the threshold circuit 10 sends an output signal to the warning circuit 6, which issues a warning signal at the time $t_1$ as shown by FIG. 2($V_s$), to light a lamp or ring a buzzer.

The sensitivity of the detection is largely influenced by changes of the capacitance $C_o$ between the antenna wire S and the ground which is dependent on the length of the antenna wire S and height of the antenna wire S from the ground. Therefore, the conventional system has had a problem that the apparatus can not necessarily has a sensitivity as designed, since the design is made for an average antenna wire of average height and length, or in other words, the use of the apparatus is only for a limited range of height and length of the antenna. Moreover, to provide a pair of wires may have a difficulty in actual case because of surrounding conditions.

SUMMARY OF THE INVENTION

The present invention is made to solve the abovementioned problems of the conventional intrusion warning system.

The system in accordance with the present invention can perform the intrusion alarm with high sensitivity regardless of variation of the length or height of the antenna wire.

BRIEF DESCRIPTION OF THE DRAWINGS

FIG. 1(*a*) is a block diagram of an example of the conventional intrusion warning system.

FIG. 1(*b*) is an equivalent circuit of the system of FIG. 1(*a*).

FIG. 1(*c*) is a schematic chart illustrating the passing of a man under an antenna of the system.

FIG. 1(*d*) is a graph showing change of input signal to an amplifier 7 of FIG. 1(*a*) in relation to the positions in FIG. 1(*c*).

FIGS. 3(*b*) and (*c*) are circuit diagrams showing examples of the coupling impedance 2 of FIG. 3(*a*).

FIG. 3(*d*) is a circuit diagram showing an example of the input impedance 3 of FIG. 3(*a*).

FIG. 4(*b*) is a schematic chart illustrating the passing of a man under an antenna of the system of the present invention.

FIG. 4(*c* ) is a graph showing change of input signal to an amplifier 7 of FIG. 3(*a*) in relation to the position in FIG. 4(*b*).

FIG. 5(*b*) is a chart showing relation between detection voltage $\Delta V$ and resistance $R_m$ of a coupling resistor as a coupling impedance 2 of the present invention.

FIG. 5(*c*) is a block diagram of a coupling impedance 2 of the present invention.

FIG. 5(*d*) is a detailed circuit diagram of an example of a coupling resistance of the present invention.

FIG. 5(*e*) is a detailed circuit diagram of an example of a coupling capacitance of the present invention.

FIG. 5(*f*) is a detailed circuit diagram of an example of a coupling resistance of the present invention.

DESCRIPTION OF THE PREFERRED EMBODIMENT

Figure 2:
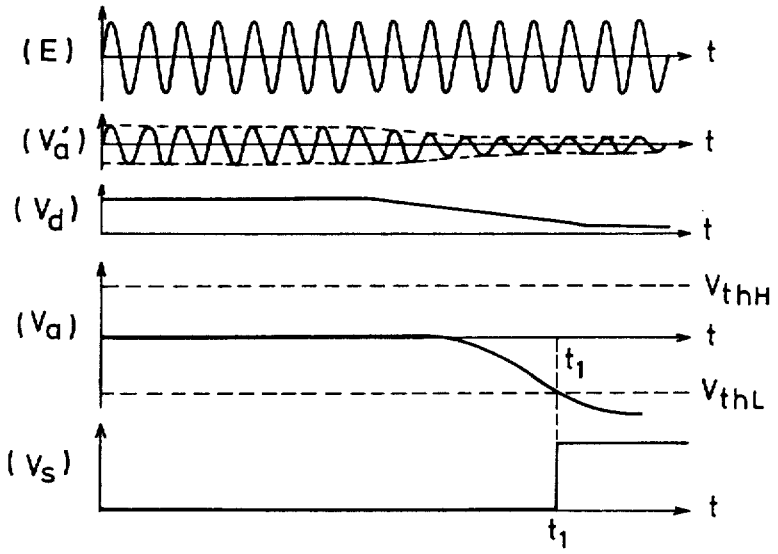
FIG. 2 (Prior Art)
FIG. 2 is a waveform chart showing waveforms of electric signal at various parts of the system of FIG. 1(*a*).
Figure 3:
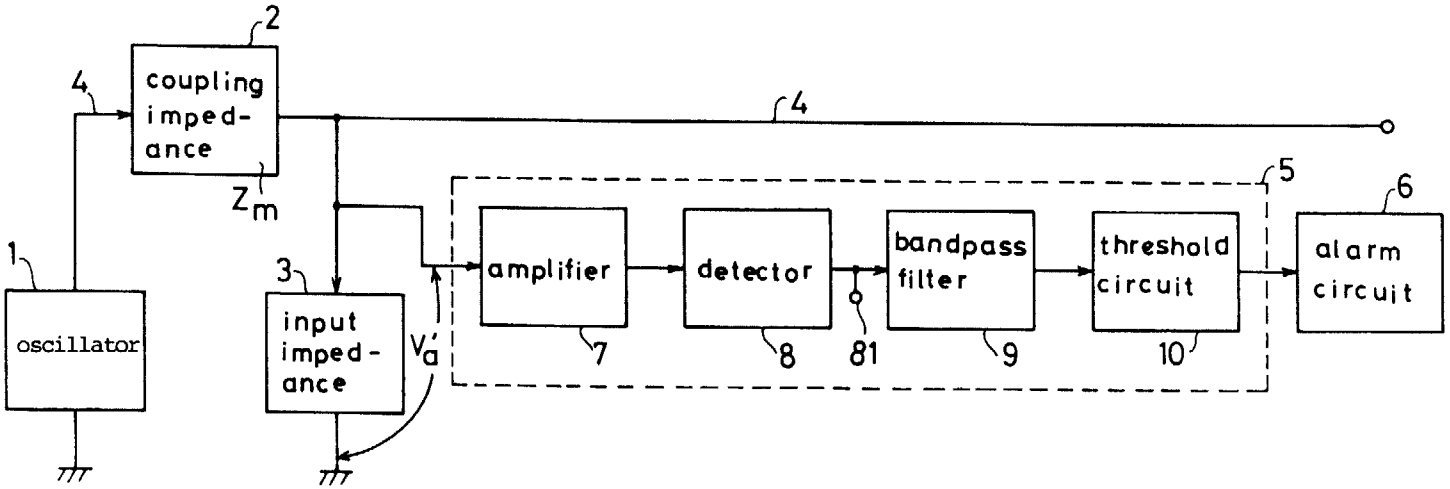
FIG. 3(*a*) is a block diagram of an example embodying the present invention.
Figure 3:
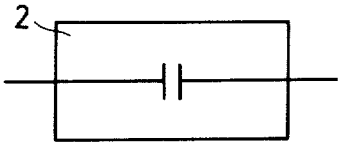
Figure 3:
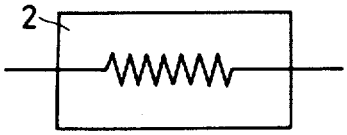
Figure 3:
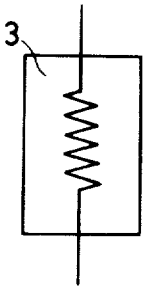

Hereafter the present invention is elucidated in detail referring to the drawings FIG. 3(*a*) and thereafter showing examples embodying the present invention. In FIG. 3(*a*), which shows a block diagram of an example of the present invention, an antenna 4 is connected through a coupling impedance 2 to a high frequency oscillator 1, so that the high frequency current of FIG. 4(*a*)(E) from the oscillator 1 is fed to the antenna 4 through the coupling impedance 2. An input impedance 3 is connected across the antenna 4 and the ground, and the high frequency voltage across the input impedance 3 is input to the signal processing part 5, which comprises an amplifier 7, a detector 8, a band-pass filter 9 of very low pass-band frequency such as 0.08 to 0.3 Hz, a threshold value detection circuit 10 and an alarm circuit 6.

The coupling impedance 2 is, for example, a capacitor, or a resistance and concerning the value thereof a detailed explanation will be given later. For the input impedance 3, a high resistance is used.

Now, provided that an impedance between the antenna 4 and the ground is sufficiently large, the induced voltage V for the case that there is no intruder is given by $$V = \frac{C_1}{C_1 + C_o} \cdot e \tag{3}$$

wherein $C_1$ . . . is the capacitance of the coupling impedance 2, $C_o$ . . . is a capacitance between the antenna 4 and the ground, e . . . is a voltage of the high frequency signal fed from the oscillator 1.

Then, by considering the intruder's body as an electric conductor, and capacitance between the intruder's body and the antenna 4 is $C_M$, the induce voltage $V_a'$ becomes as shown by the following equation (4):

$$V'_a = \frac{C_1}{C_1 + C_o + C_M} \cdot e. \tag{4}$$

Figure 4:
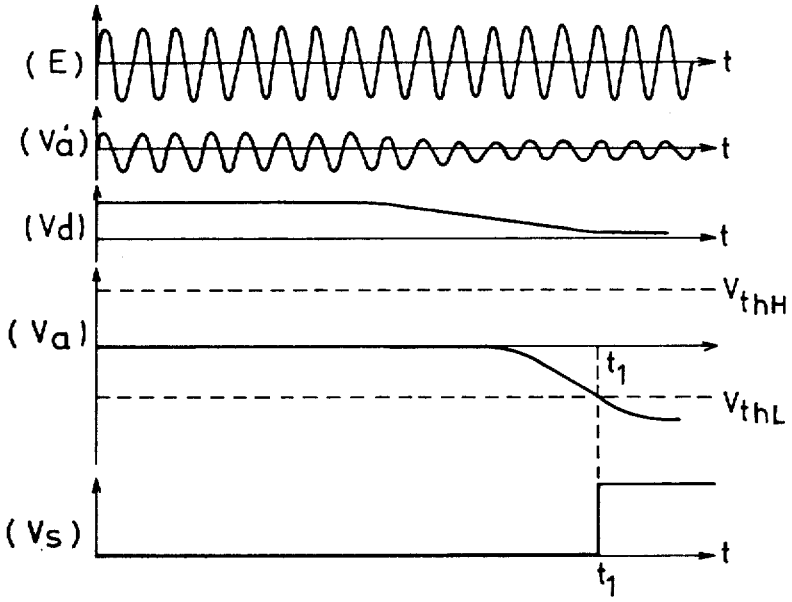
FIG. 4(*a*) is a waveform chart showing waveforms of electric signal at various parts of the system of FIG. 3(*a*).
Figure 4:
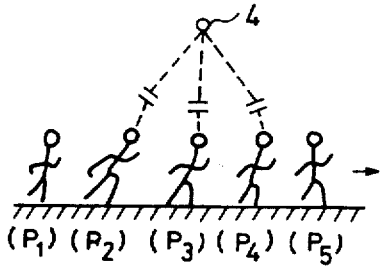
Figure 4:
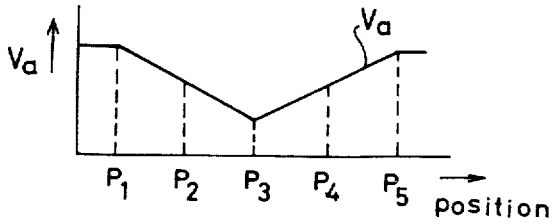

The induced voltage $V_a'$ is amplified by an amplifier 7, then detected as FIG. 4(*a*)($V_d$) by a detection circuit 8, and after passing a band-pass filter 9 led to a threshold circuit, where its input value $V_a$ is compared with a predetermined threshold value $V_{thL}$.

When a man passes through the electric field of the antenna 4 as shown by FIG. 4(*b*), the induced voltage changes as shown by FIG. 4(*a*)($V_a'$) by the change of the capacity $C_M$, and therefore, the input voltage $V_a$ to the threshold circuit 10 changes as shown by FIG. 4(*a*)($V_a$) and FIG. 4(*c*). Therefore, when the input voltage $V_a$ becomes lower than the predetermined threshold value $V_{thL}$ as shown by FIG. 4(*a*)($V_a$) at the time $t_1$, the threshold circuit 10 sends an output signal to the warning circuit 6, which issues a warning signal at the time $t_1$ as shown by FIG. 4(*a*)($V_s$), to light a lamp or ring a buzzer.

The equations (3) and (4) are substantially the same as those of (1) and (2) as easily be understood. Therefore, it is obvious that, in the same way as by the conventional system of FIG. 1(*a*), it is possible to detect the intruder through a voltage change of the antenna 4, which is a single field wire in the art of the present invention. Since only a single antenna wire is used, there is no problem that a strong wind causes undesirable variation of wire to wire gap between parallel wires, and the cost of construction of the system are reduced. Only requirement of the wire construction is to keep the height of wire uniform on the ground. And the single wire antenna system is less sensitive to the undesirable vibration by the wind than the conventional two wire system, and accordingly there is smaller possibility of false alarming.

For the coupling impedance 2, other impedance such as resistance as shown in FIG. 3(*c*) can be used.

For the input impedance 3, a high resistance as shown by FIG. 3(*d*) is ordinary used.

Figure 5:
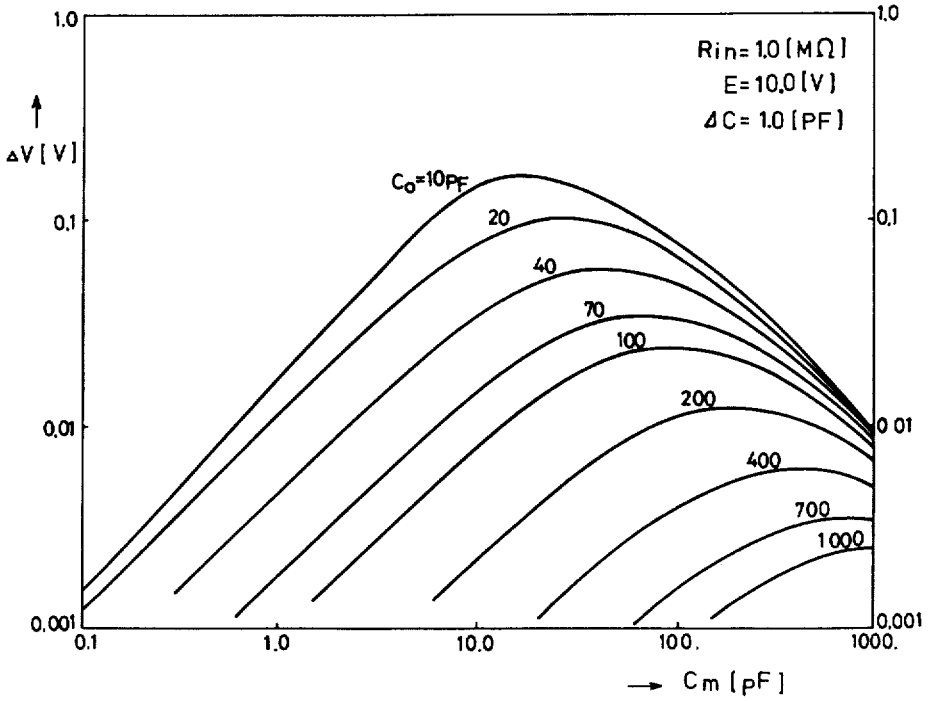
FIG. 5(*a*) is a chart showing relation between detection voltage $\Delta V$ and capacitance $C_m$ of a coupling capacitor as a coupling impedance 2 of the present invention.
Figure 5:
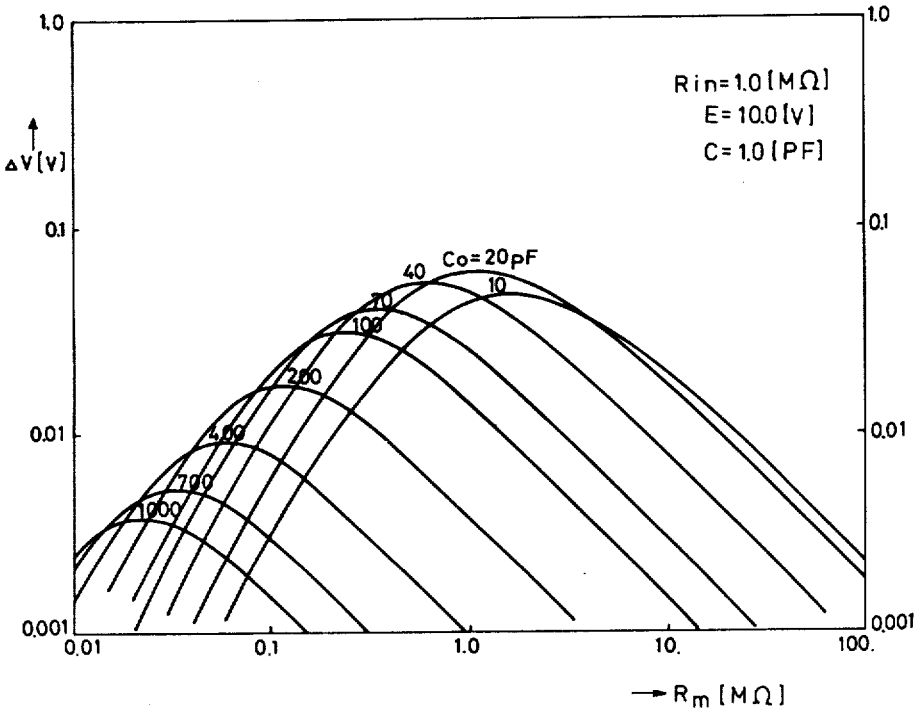
Figure 5:
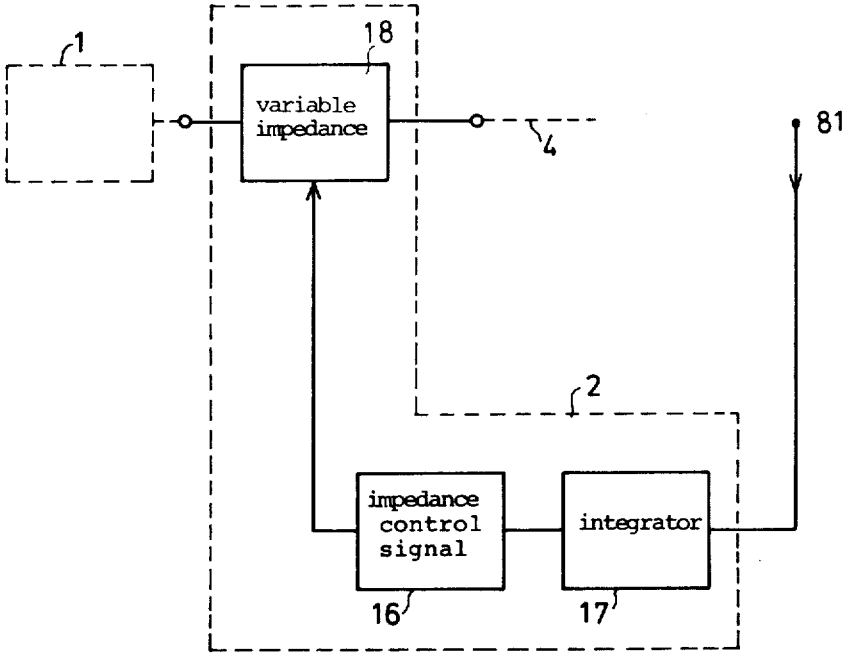
Figure 5:
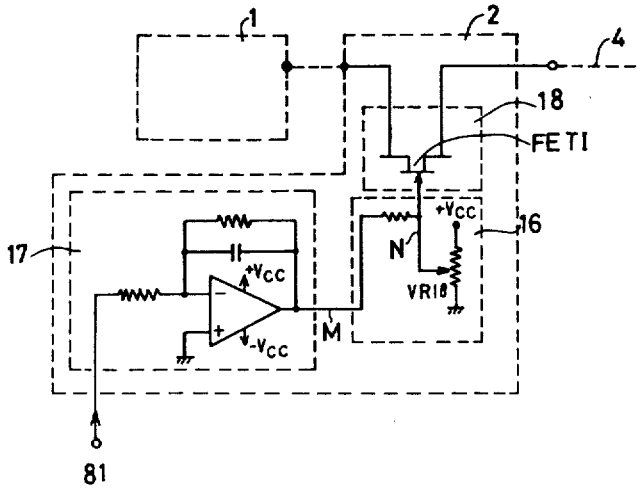
Figure 5:
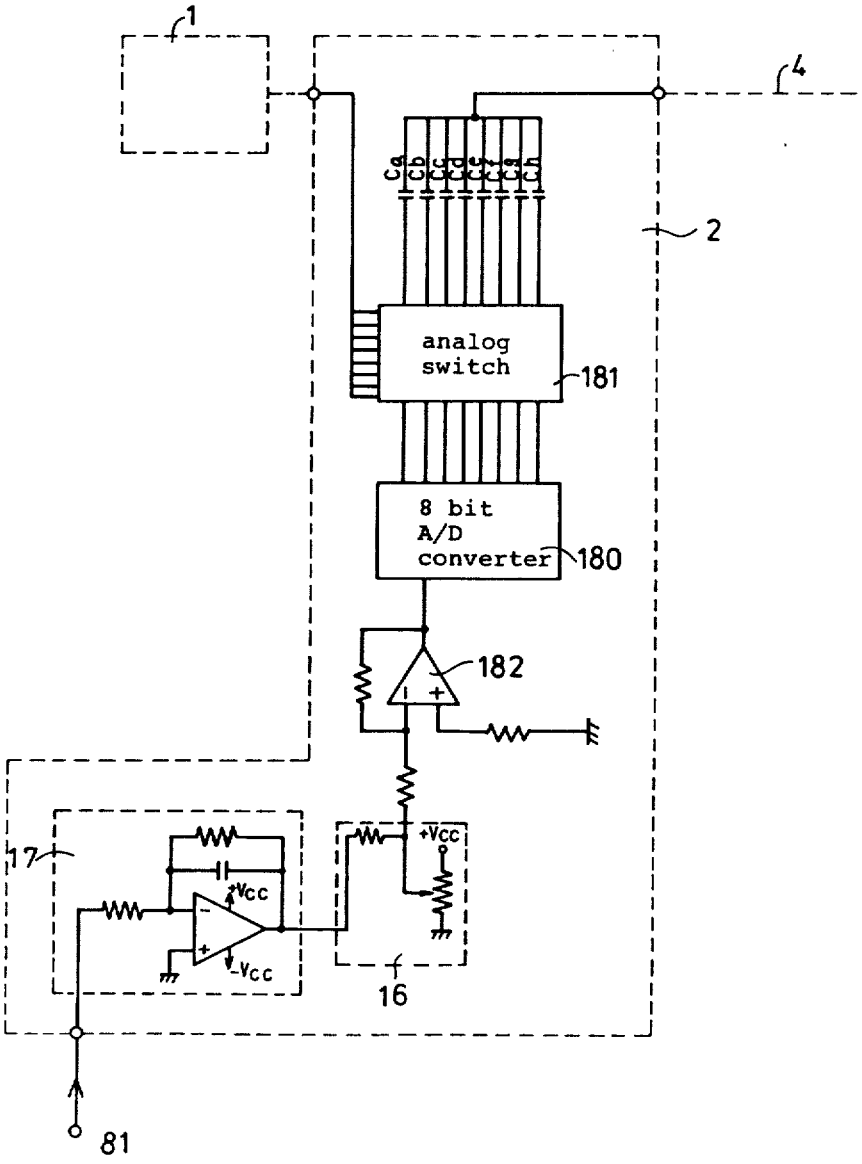
Figure 5:
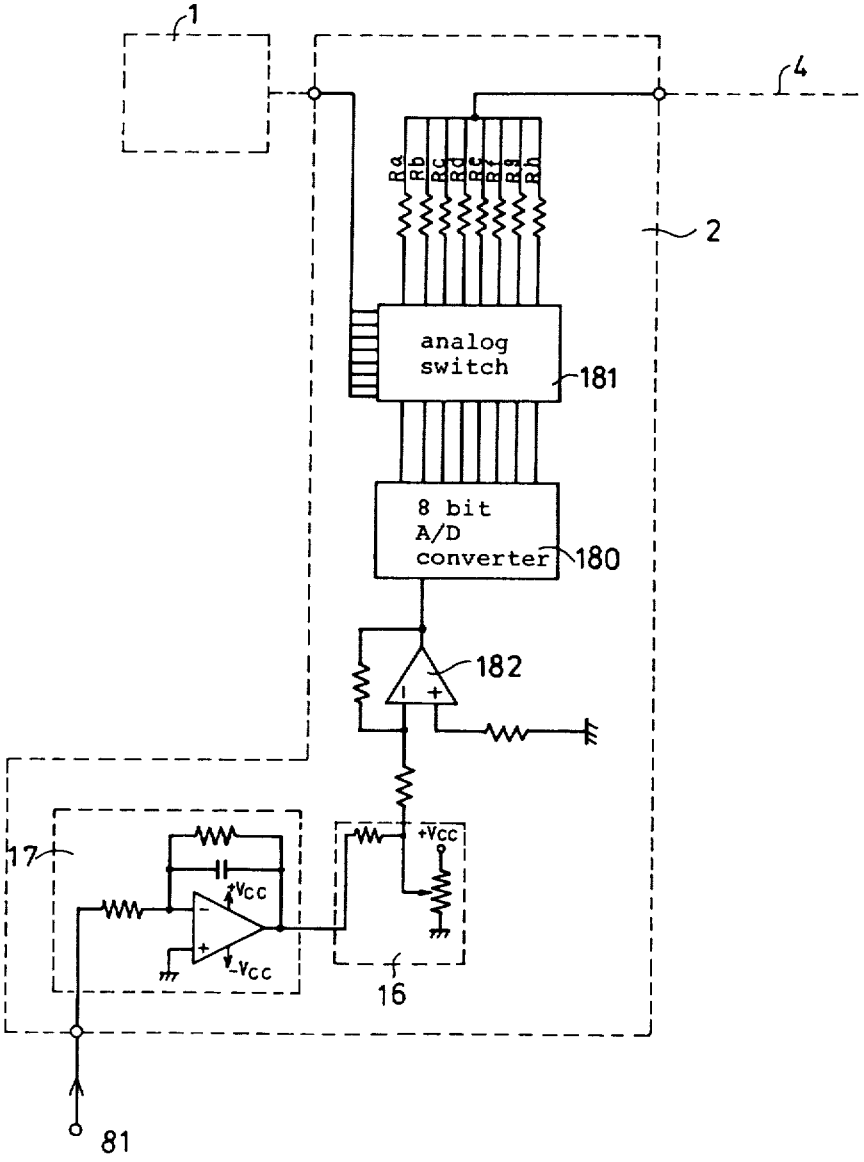

The inventors examined the relation between the values of the coupling impedance 2 and the impedance of the antenna 4. FIG. 5(*a*) shows a relation between the capacitance $C_m$ of the capacity as the coupling impedance 2 and amount of voltage change $\Delta V$ of the antenna 4 for 1 pF change of the capacitance $C_o$ (between the antenna 4 and the ground). The parameters are values of the capacitance $C_o$. This graph shows that the voltage change $\Delta V$, that is the detection output, has a maximum value with respect to change of the capacitance value $C_m$ of the coupling capacitor, and that the optimum conditions are at the cases where the coupling capacitance $C_m$ is almost equal to the capacitance $C_o$. From the abovementioned fact, it is induced that the coupling capacitance $C_m$ preferably should be controlled to the value substantially equal to the capacitance $C_o$. The inventors further examined the relation between the values of a coupling resistance $R_m$ as the coupling impedance 2 and the amount of voltage change $\Delta V$ of the antenna 4 for 1 pF change of the capacitance $C_o$ between the antenna 4 and the ground, as shown in FIG. 5(*b*). The parameters are values of the capacitance $C_o$. The frequency of the oscillator is about 10 kHz. This graph shows that the voltage change $\Delta V$, that is the detection output, has a maximum value with respect to change of the resistance value $R_m$ of the coupling resistor, and that the optimum conditions are at the cases where the resistance $R_m$ is almost equal to the impedance of the capacitor $C_o$.

From the abovementioned consideration, in order to obtain maximum detection output, it is ideal that the coupling impedance is controlled to an appropriate value in a manner that the value of the coupling impedance 2 becomes substantially equal to the value of the impedance between the antenna 4 and the ground, in other words, that the voltage across the antenna 4 and the ground is substantially the half of the voltage fed to the input side of the coupling impedance 2. Furthermore, from the comparison of FIG. 5(*a*) and FIG. 5(*b*), in the case of input resistance $R_{in} = 1\ M\Omega$, for the conditions of $C_o > 50$ pF the use of resistor as the coupling impedance 2 gives higher output voltage, and for $C_o < 50$ pF, the use of capacitor as the coupling impedance 2 gives higher output.

FIG. 5(*c*) shows an example of a circuit which enable the abovementioned ideal control of the coupling impedance. Therein the coupling impedance 2 includes a variable impedance 18 and its impedance value is controlled by a signal from an impedance control circuit 16. For example, the variable impedance 18 can be a variable capacitance diode which changes its capacitance by a D.C. control voltage thereon. The circuit 2 also comprises an integration circuit 17 or a low pass filter of a very low cut off frequency which integrate the output voltage of the detector circuit 8, that is the voltage of the output terminal 81 of the detector circuit 8, and gives its integrated or low-passed output to the impedance control circuit 17. The abovementioned circuits form a feed back loop together with the input impedance 3, the input amplifier 7 and the detector 8. The feed back loop functions as follows: When the output signal at the output terminal 81 is lowered from a predetermined level, and therefore the output of the integration circuit 17 becomes low, then the lowered voltage is impressed on the gate electrode of an FET, which constitutes a variable impedance 18. Therefore the effective source-drain resistance of an FET in the variable impedance circuit 18 is lowered. By means of such change of the source-drain resistance, the coupling impedance 2 is controlled, so that the output at the output terminal 81 rises to the predetermined value. By means of such feed back operation, the voltage of the antenna 4 is adjusted to the voltage of the input side of the coupling impedance 2. In this circuit, the integration circuit or the low pass filter circuit 17 is provided in order that the controlling, i.e., changing of the coupling impedance 2 is not carried out when a relatively quick change of the voltage is produced at the antenna 4 by means of detection of the intruder. Therefore, the integration circuit or the low pass filter circuit 17 is designed in a manner not to issue output signal when change of voltage is such quick that is caused by the motion of human body. That is, the loop responds only very much slowly, so that intrusion detection signals does not extinguish by the feed back motion.

FIG. 5(*d*) is a circuit diagram of a more concrete circuit structure of the coupling impedance part shown in FIG. 5(*c*). The circuit 2 of FIG. 5(*d*) corresponds to the coupling impedance 2 of FIG. 3(*a*) which is connected between the oscillator 1 and the antenna 4 of FIG. 3(*a*). The integration circuit 17 comprises a known operational amplifier, and the variable impedance element 18 comprises an FET (FET 1), and the impedance control circuit 16 has a variable resistor VR18 for manual adjustment of the optimum point of the impedance control.

FIG. 5(*e*) is another example of the coupling impedance 2 having an automatic adjusting function. This example has several capacitors $C_a$, $C_b$, $C_c$, $C_d$, $C_e$, $C_f$, $C_g$ and $C_h$ connected in common at one end thereof and connected to an analog switch (multiplexer) 181, which is connected to the oscillator 1. The analog switch 181 is connected by an 8-bit A/D converter 180. The circuit also comprises an integration circuit 17, an impedance control circuit 16 and an amplifier 182 which gives output to the 8-bit A/D converter 180. In this example, the analog switch 181 switches the capacitors in $2^8=256$ steps of capacitance by means of combination of capacitors and adjust the coupling capacitance to such a suitable value that gives the antenna voltage which is about half of the voltage given from the oscillator 1.

By means of the abovementioned feed back circuit loop containing the variable impedance 2 therein, the high frequency voltage fed from the oscillator 1 to the antenna 4 is adjusted to a highest value irrespective of variation of the capacitance $C_o$ of the antenna to ground, that is, irrespective of variations of the length, height and number of the antenna to be connected to the coupling impedance. Therefore, it is very easy to install the system.

FIG. 5(*f*) shows still another example of the coupling impedance 2, wherein resistances Ra, Rb, Rc . . . Rh . . . e connected so as to be switched by the analog switch 181. The operation is similar to that of FIG. 5(*e*).

What is claimed is:

1. An intrusion warning system for detecting the presence of an intruder in a given area comprising:

an antenna provided around the given area, said antenna being insulated from ground;

an oscillator for feeding an alternating current signal to said antenna;

a coupling impedance means connected between an output of said oscillator and said antenna, said coupling impedance means including a means for varying impedance to obtain optimum detection sensitivity;

a signal processing means for detecting the alternating current signal on said antenna and producing an output signal in response to a change in the alternating current signal on said antenna exceeding a predetermined level;

said means for varying impedance comprising a feedback loop from said signal processing means to said coupling impedance, said feedback loop including an integrator circuit for integrating the alternating current signal on said antenna and an impedance control means for controlling the impedance value of said coupling impedance in accordance with integrated value, so that changing of the coupling impedance is carried out only for slow changes in the detected alternating current on said antenna and not for rapid changes due to the presence of an intruder in the given area.

2. An intrusion warning system in accordance with claim 1 wherein said coupling impedance is controlled by said means for varying impedance such that the value of the coupling impedance is substantially equal to the value of the impedance between said antenna and ground.

3. An intrusion warning system in accordance with claim 2 wherein said antenna comprises a single wire antenna.

4. An intrusion warning system in accordance with claim 2 wherein said coupling impedance is a voltage-controlled variable impedance.

5. An intrusion warning system in accordance with claim 4 wherein said coupling impedance is an FET, and in which said impedance control means comprises a source-drain circuit of said FET controlled in accordance with the integrated value of the alternating current signal on said antenna.

6. An intrusion warning system in accordance with claim 5 wherein the source-drain circuit of said FET also includes a variable resistor for manually adjusting the optimum value of control of the impedance of said coupling impedance.

7. An intrusion warning system in accordance with claim 4 wherein said coupling impedance comprises a variable capacitance diode controlled by the integrated value of the alternating current signal on said antenna.

* * * * *